United States Patent [19]

LaMont et al.

[11] Patent Number: 4,931,780

[45] Date of Patent: Jun. 5, 1990

[54] ILLUMINATED ADDRESS IDENTIFIER AND ALARM DEVICE

[76] Inventors: David G. LaMont; Madeline A. LaMont; Richard T. Donnell, all of 11049 W. Crimson La., Phoenix, Ariz. 85039

[21] Appl. No.: 355,426

[22] Filed: May 23, 1989

[51] Int. Cl.[5] ..... G08B 3/00

[52] U.S. Cl. ..... 340/691; 307/66; 340/326; 340/331

[58] Field of Search ..... 340/691, 693, 573–574, 340/538, 326, 331–332; 379/38, 40; 361/170; 307/64, 66; 250/206

[56] References Cited

U.S. PATENT DOCUMENTS

| | | | |
|---|---|---|---|
| 3,863,236 | 1/1975 | Clardy | 340/326 |
| 3,911,425 | 10/1975 | Muncheryan | 340/326 |
| 4,003,040 | 1/1977 | Browand | 340/332 |
| 4,177,405 | 12/1979 | Chapdelaine | 250/206 X |
| 4,518,946 | 5/1985 | Solomon | 340/326 |
| 4,547,761 | 10/1985 | Jones | 340/331 |
| 4,686,505 | 8/1987 | Vanderburg | 340/331 |
| 4,791,658 | 12/1988 | Simon et al. | 379/41 |
| 4,839,630 | 6/1989 | Miller | 340/574 |

*Primary Examiner*—Joseph A. Orsino
*Assistant Examiner*—Thomas J. Mullen, Jr.
*Attorney, Agent, or Firm*—Jerry T. Kearns

[57] ABSTRACT

Lighted house numbers at night aid in the locating of an address in a non-emergency mode and becomes an alarm device including a control unit connected to a telephone within a dwelling to detect dialling of a 911 signal. A housing is mounted exteriorly of the dwelling and includes audible and visual alarms operatively connected for activation upon detection of a 911 signal by the control unit. The remote alarm unit includes indicia illuminated for identifying an address at night when operating in a non-emergency mode and directing rescue personnel to the dwelling after a dwelling occupant has dialled 911 and activates an emergency strobe light and audible alarm mode illuminating the general vicinity of the dwelling from a distance and ultimately pinpointing the exact location of the emergency 911 caller. The visual and audible alarms in the remote unit are connected through a rectifier and transformer to an AC power source within the dwelling. The remote alarm unit includes a back up battery power supply which is automatically connected upon AC power failure.

1 Claim, 4 Drawing Sheets

ILLUMINATED ADDRESS IDENTIFIER AND ALARM DEVICE

BACKGROUND OF THE INVENTION

1. Field of the Invention

The present invention relates to alarm devices, and more particularly pertains to an alarm device which is automatically actuated by an individual dialling a 911 signal on a conventional telephone. The 911 system has become standardized throughout the country and most cities and towns include emergency rescue units which will quickly respond to an individual dwelling unit upon receiving such a call. Larger metropolitan areas include an automatic computerized system which will automatically display the street address associated with a particular phone number from which the dialled 911 signal is received. In spite of these modern systems, rescue personnel frequently have difficulty in locating the particular dwelling upon responding and nearing the address vicinity. In order to overcome this problem, the present invention provides an alarm system which includes an exterior housing having indicia representing a particular street address. Upon detection of a 911 signal dialled from a telephone within the dwelling, the audible and visual alarms in the remote alarm housing are activated to direct rescue personnel to the dwelling.

2. Description of the Prior Art

Various types of alarm devices are known in the prior art. A typical example of such an alarm device is to be found in U.S. Pat. No. 3,863,236, which issued to L. Clardy on Jan. 28, 1975. This patent discloses a lighting and signalling device adapted to be mounted exteriorly of a dwelling and including audible and visual alarms. The device is actuated manually by a single pole switch and is connected to a conventional source of AC power within the dwelling. No back up power supply is provided in the event of power failure. U.S. Pat. No. 3,911,425, which issued to H. Muncheryan on Oct. 7, 1975, discloses an alarm system for signalling for emergency help during sudden illness or criminal dwelling intrusion. The system includes an intermittently sounding alarm with a concurrently flashing visual indicator which signals by illuminating large letters of the word "HELP". The system is operated remotely by manually turning on an emergency switch or by an automatic wireless switching device using a microwave transmitter-receiver arrangement. The device is provided with a timing mechanism which turns on the audible alarm with the flashing light at a predetermined time. The signalling unit is positioned facing toward the street in front of a dwelling so as to be visible to neighbors and passerbys. U.S. Pat. No. 4,003,040, which issued to C. Browand on Jan. 11, 1977, discloses a flashing address indicating door sign having a casing with illuminable house numbers. The casing contains red and white light bulbs which are selectively operable by a manual switch located inside of a dwelling. U.S. Pat. No. 4,518,946, which issued to D. Solomon on May 21, 1985, discloses an audio visual alarm encased in a housing formed of a translucent material. U.S. Pat. No. 4,547,761, which issued to R. Jones on Oct. 15, 1985, discloses a distress light and signal system including a light adapted to be anchored in the ground in proximity to a road passing by a house. The light includes a switch for selectively actuating the light in an emergency from within the house and is powered by a solar collector and a rechargeable battery. Information is retained at a location remote from the house including directions for use by a person responding to the emergency. The system includes immediate retrieval of the information upon notification of the existence of an emergency at the house.

While the above mentioned devices are suited for their intended usage, none of these devices disclose a remote alarm unit including illuminated street address indicating indicia for use in a non-emergency mode and also connected for actuation upon detection of the dialling of a 911 signal from a phone within the dwelling to activate an emergency mode illuminating the general vicinity of the dwelling from a distance and ultimately pinpointing the exact location of the emergency 911 caller. Additionally, none of the aforesaid devices disclose a remote alarm connected by a transformer and a rectifier to an AC power source within a dwelling and including a relay for selectively connecting a back up battery power supply upon AC power failure. Inasmuch as the art is relatively crowded with respect to these various types of alarm devices, it can be appreciated that there is a continuing need for and interest in improvements to such alarm devices, and in this respect, the present invention addresses this need and interest.

SUMMARY OF THE INVENTION

In view of the foregoing disadvantages inherent in the known types of alarm devices now present in the prior art, the present invention provides an improved alarm device. As such, the general purpose of the present invention, which will be described subsequently in greater detail, is to provide a new and improved alarm device which has all the advantages of the prior art alarm devices and none of the disadvantages.

To attain this, a representative embodiment of the concepts of the present invention is illustrated in the drawings and makes use of an alarm device including a control unit connected to a telephone within a dwelling to detect dialling of a 911 signal. A housing is mounted exteriorly of the dwelling and includes audible and visual alarms operatively connected for activation upon detection of a 911 signal by the control unit. The remote alarm unit includes illuminated indicia to identify a street address at night in a non-emergency mode and a strobe light and audible alarm to direct rescue personnel to the dwelling after a dwelling occupant has dialled 911 activating an emergency mode illuminating the general vicinity of the dwelling from a distance and ultimately pinpointing the exact location of the emergency 911 caller. The visual and audible alarms in the remote unit are connected through a rectifier and transformer to an AC power source within the dwelling. The remote alarm unit includes a back up battery power supply which is automatically connected upon AC power failure.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood txat s 8CIBG for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved alarm device which has all the advantages of the prior art alarm devices and none of the disadvantages.

It is another object of the present invention to provide a new and improved alarm device which may be easily and efficiently manufactured and marketed.

It is a further object of the present invention to provide a new and improved alarm device which is of a durable and reliable construction.

An even further object of the present invention is to provide a new and improved alarm device which is susceptible of a low cost of manufacture with regard to both materials and labor, and which accordingly is then susceptible of low prices of sale to the consuming public, thereby making such alarm devices economically available to the buying public.

Still yet another object of the present invention is to provide a new and improved alarm device which provides in the apparatuses and methods of the prior art some of the advantages thereof, while simultaneously overcoming some of the disadvantages normally associated therewith.

Still another object of the present invention is to provide a new and improved alarm device which includes a remote alarm connected for activation upon detection of a dialled 911 emergency phone call.

Yet another object of the present invention is to provide a new and improved alarm device for illuminating the address of a dwelling at night in a non-emergency mode and to direct rescue personnel upon detection of a dialled 911 phone call on a telephone within the dwelling activating an emergency mode of a strobe light and audible alarm, illuminating the general vicinity of the dwelling from a distance and ultimately pinpointing the exact location of the emergency 911 caller.

Even still another object of the present invention is to provide a new and improved alarm device having a housing bearing illuminated indicia representing the street address of a dwelling operating in a non-emergency mode connected to a control unit for activation of an emergency mode upon detection of a dialled 911 phone call activating a strobe light and audible alarm illuminating the general vicinity from a distance and ultimately pinpointing the exact location of the 911 emergency caller and including a primary power supply and an automatically connected secondary power supply.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
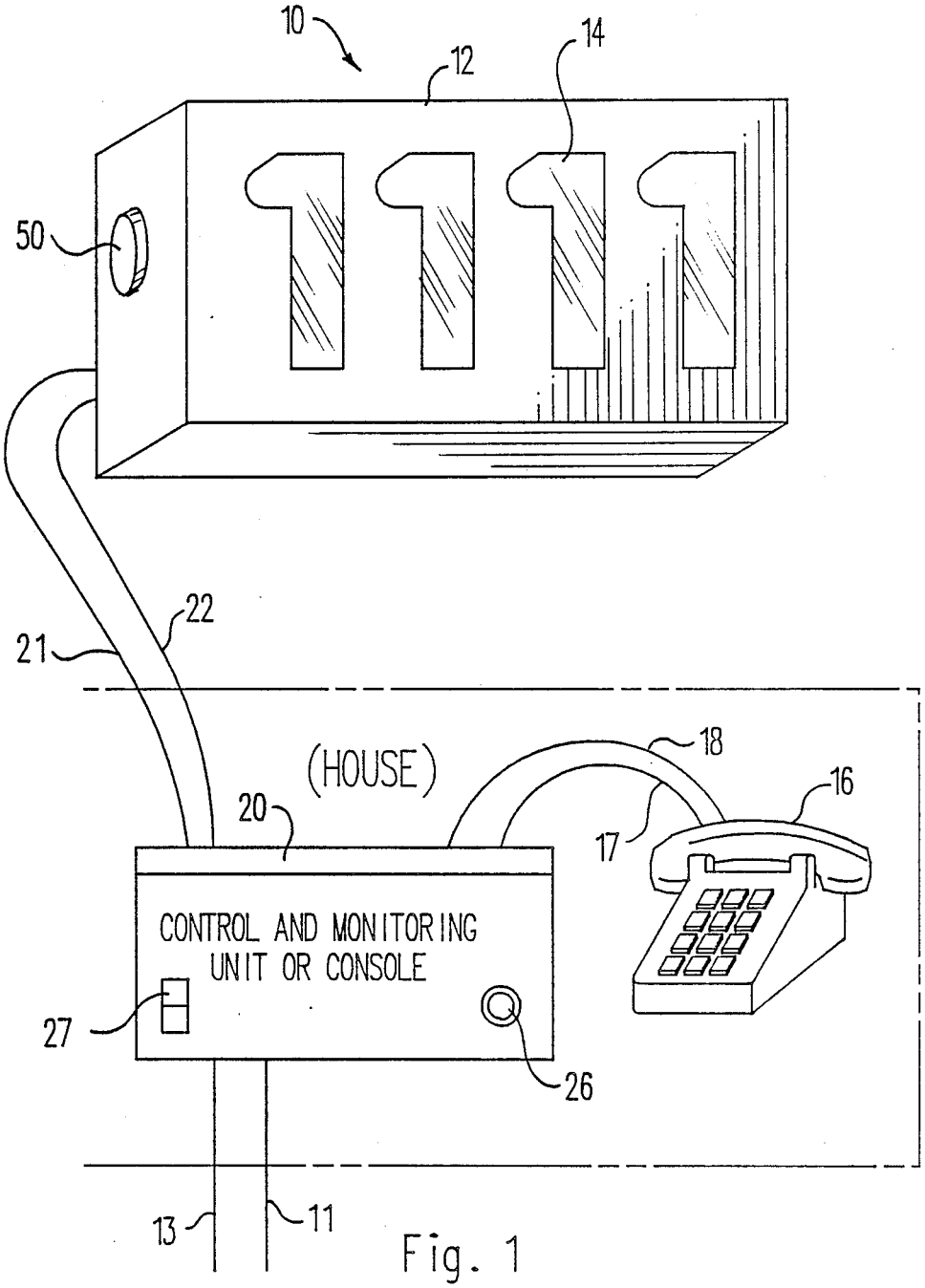
FIG. 1 is a diagrammatic view illustrating the alarm device of the present invention.

With reference now to the drawings, and in particular to FIG. 1 thereof, a new and improved alarm device embodying the principles and concepts of the present invention and generally designated by the reference numeral 10 will be described.

More specifically, it will be noted that the first embodiment 10 of the invention includes a remote alarm unit including a rectangular housing 12 preferably formed from a translucent plastic material. A plurality of street address indicating numbers 14 are provided on a front face of the housing 12 and may be formed by transparent portions in the housing wall. The housing 12 may for example be formed from a translucent red plastic material and the numbers 14 may be formed from a white plastic material. A conventional telephone 16 within a dwelling or house is connected to a control unit 20 by conventional phone lines 17 and 18. The service telephone lines 11 and 13 are connected to the phone 16 through the control unit 20. Output signals 21 and 22 from the control unit 20 are transmitted to the receiver in the remote alarm unit 12 for activating visual and audible alarms therein. The housing 12 is preferably mounted exteriorly of the dwelling to direct rescue personnel to the dwelling. For example, the housing 12 may be mounted on the front exterior wall replacing existing exterior porch light, doorway light or garage light. The control unit 20 includes conventional logic circuitry for detecting a dialled 911 signal by the phone 16. Conventional circuitry such as that utilized to generate tone signals in emergency 911 systems may be utilized. In locations which do not utilize the 911 emergency number, the control unit 20 may be suitably programmed to detect the appropriate emergency number. The control unit 20 does not interfere with the normal use Of the phOne 16 and is only actuated upon detection of an outgoing emergency 911 tone signal.

Figure 2:
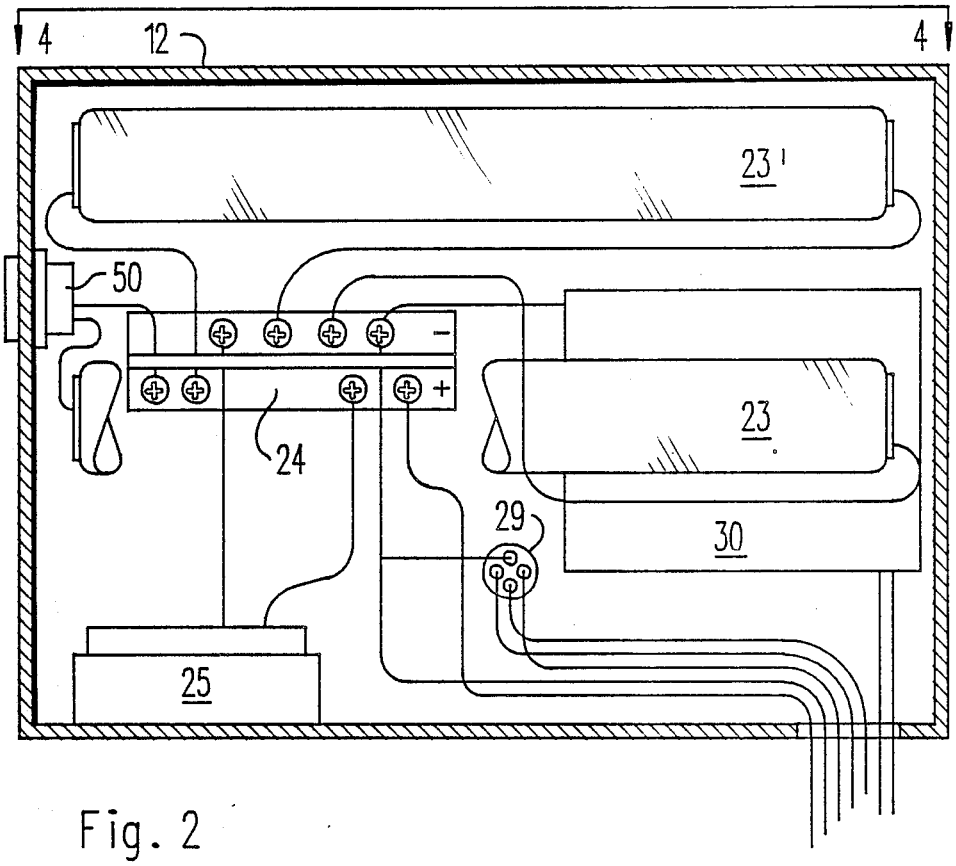
FIG. 2 is a cross sectional view, illustrating the construction of the remote alarm unit.

FIG. 2 illustrates a cross sectional view of the housing 12 and the interior components thereof. A light 23, which is constantly illuminated in an non-emergency mode, and a strobe light 23', which is actuated in an emergency mode, are disposed therein along with an audible alarm 25. A switch 27 (FIG. 1) on the control unit 20 is connected for manually deactuating the light 23' and the audible alarm 25. A low current indicating light or LED 26 on the control unit 20 indicates power supply to the unit. A relay 29 is operatively connected for actuating the lights 23, 23' and the audible alarm 25 upon detection of the 911 signal by the control unit 20. A back up battery power source and recharging unit 30 is disposed in the interior of the housing 12, in the event of failure of the external power supply. A terminal block 24 is provided for connecting the various components. A photocell 50 is operatively connected to illuminate the light 23 at nightfall in the nonemergency mode.

Figure 3:
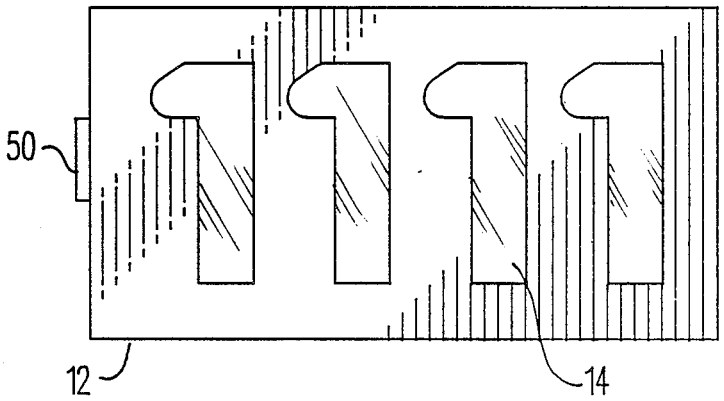
FIG. 3 is a front view of the remote alarm unit, illustrating the street address indicating indicia.

FIG. 3 illustrates a front plan view of the housing 12 and the street address illuminating indicia 14.

Figure 4:
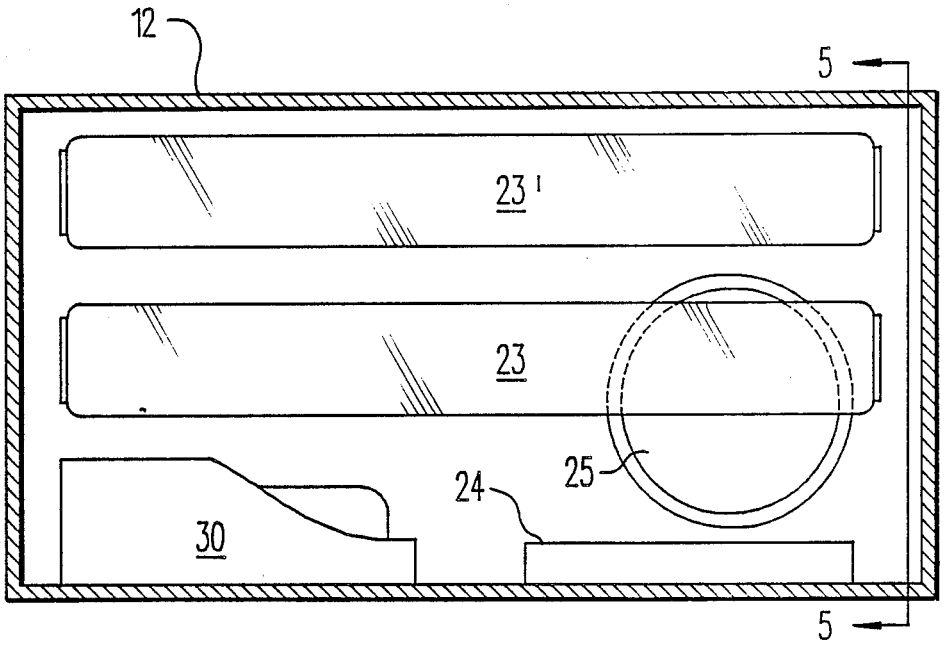
FIG. 4 is a cross sectional view, taken along line 4—4 of FIG. 2.

FIG. 4 is a cross sectional view, taken along line 4—4 of FIG. 2 which further illustrates the interior components of the remote alarm unit 12.

Figure 5:
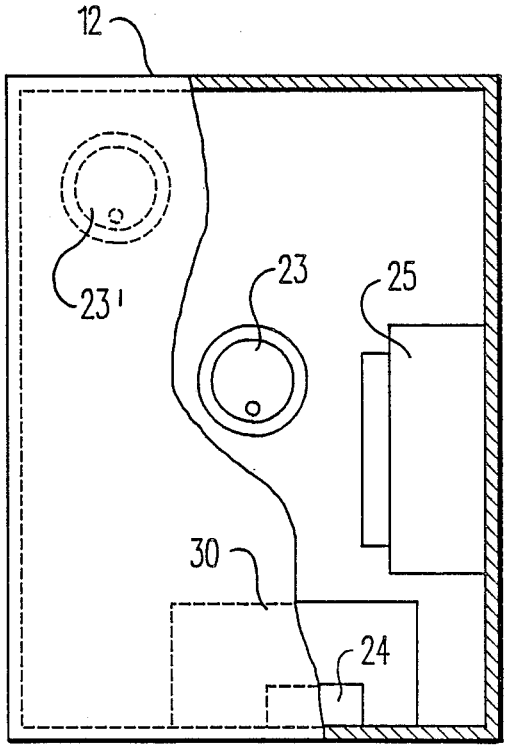
FIG. 5 is a cross sectional view, taken along line 5—5 of FIG. 4.

FIG. 5 is a cross sectional view, taken along line 5—5 of FIG. 4.

Figure 6:
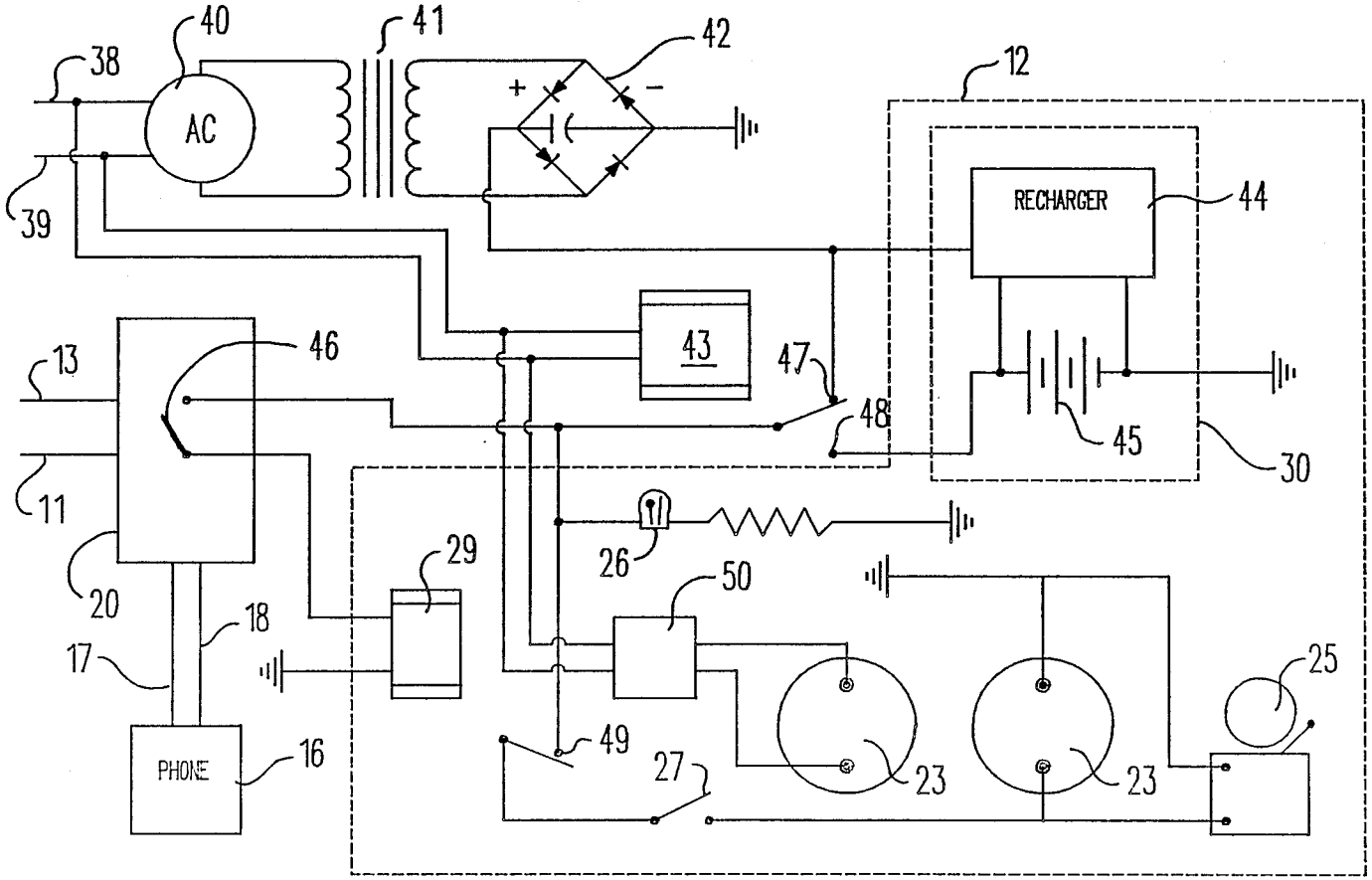
FIG. 6 is a schematic diagram illustrating the electrical components of the alarm device of the present invention.

With reference now to FIG. 6, the electrical components of the alarm system of the present invention will now be described. The power to the remote alarm unit 12 is normally supplied from an AC power source 40 conventionally connected by power lines 38 and 39 to the dwelling. A transformer 41 has a secondary stage connected to a rectifier 42 for producing a DC power supply to the remote alarm unit 12. The rectifier 42 is connected to a recharging unit 44 which maintains a rechargeable battery 45 in a charged condition. A double throw relay 43 has a coil connected to the AC power lines 38 and 39. Thus, the coil is constantly energized. A first input contact of the relay 43 is connected to the rectifier 42 and a second input contact 48 is connected to the back up battery power source 45. The output contact of the relay 43 will be in the illustrated position in engagement with the contact 47, unless the AC power fails. Upon an AC power failure, the coil of the relay 43 will be de-energized and the relay output contact will engage the secondary input contact 48, connecting the battery back up power 45. The control unit 20 includes conventional internal logic circuitry which performs a switching function diagrammatically indicated by a switch 46. Upon detection of a 911 signal from the phone 16 on line 17 and 18, the control unit 20 closes the switch 46 which connects the DC power output contact of the relay 43 to the coil of a relay 29 within the remote alarm unit 12. The control unit 20 does not interfere with the outgoing call, which is transmitted in a conventional fashion over external phone lines 11 and 13. Upon activation of the coil of the relay 29, the relay 29 closes the contact 49, which is connected to the DC output of the relay 43. The manual switch 27, which is physically located on the control unit 20, will normally be in a closed position which transmits power to the constantly illuminated light 23 in the non-emergency mode and the strobe light 23', as well as the audible alarm 25 in the emergency mode. The constantly illuminated light 23 is controlled by photocell 50, to illuminate the light 23 at nightfall. The audible alarm 25 may preferably take the form of a siren or an alarm such as that utilized in a conventional smoke alarm. It should be noted that the lights 23, 23' and the audible alarm 25 are connected in parallel so that failure of either of the lights 23 or 23' will not cut the power supply to the remaining alarm units. The power indicating light 26, physically located on the control unit 20, provides an indication of a DC power supply to the alarm unit 12. If the indicating light 26 is not illuminated, this indicates either failure of the light 26 or failure of both the AC power supply and the back up battery power supply 45. Thus, the light 26 provides a possitive assurance of operability of the remote alarm unit 12. It should be noted that all of the electrical components located exteriorly of the dwelling within the remote alarm unit 12 are powered by a low voltage DC power supply, and thus no danger of electrocution is provided to individuals tampering with the housing 12, or due to fracture or other failure of the housing.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An illuminated address identifier and alarm device, comprising:

control means operatively connected to a telephone within a dwelling for detecting a dialled 911 signal;

a remote alarm unit having a housing mounted exteriorly of a dwelling;

indicia representing a street address of said dwelling on said housing;

a first light source in said housing for illuminating said indicia to aid in locating said address at night in a non-emergency mode;

a strobe light in said housing to identify said address vicinity from a distance to aid rescue personnel with a clear identification of the general location of said address and ultimately pinpointing the exact location of the emergency 911 caller;

an audible alarm in said housing;

a transformer in said dwelling having a primary stage connected to a source of AC power;

a rectifier connected to a secondary stage of said transformer for providing a DC power supply;

a battery in said housing;

a recharging unit in said housing connected to said battery and said rectifier;

a first double-throw relay having a coil connected to said AC power source;

a first input contact of said first relay connected to said rectifier;

a second input contact of said first relay connected to said battery;

an output contact of said first relay connected to a DC input of said control means;

said control means including switching means for connecting said DC input to said control output in response to detection of said 911 signal;

a second single throw relay having a coil connected for energization by said control output;

a first input contact of said second relay connected to said output contact of said first relay;

a second output contact of said second relay connected with said first input contact of said second relay upon energization of said second relay coil;

said first light independently controlled by a photocell to aid in location of said address at night in a non-emergency mode; and said first light, said strobe light and said audible alarm means connected in parallel for activation by said output contact of said second relay.

* * * * *